United States Patent [19]

Hirono et al.

[11] Patent Number: 4,828,415

[45] Date of Patent: May 9, 1989

[54] PRINTER

[75] Inventors: Tetsuro Hirono; Mikio Shinada, both of Kamakura, Japan

[73] Assignee: Mitsubishi Denki K.K., Tokyo, Japan

[21] Appl. No.: 246,677

[22] Filed: Sep. 20, 1988

[30] Foreign Application Priority Data

Sep. 22, 1987 [JP] Japan ..... 62-238404

[51] Int. Cl.[4] ..... B41J 11/50

[52] U.S. Cl. ..... 400/605; 101/232; 271/9; 271/265; 271/296

[58] Field of Search ..... 400/605, 608.2, 603, 400/578, 352; 271/3, 3.1, 9, 287–288, 292, 290, 294, 297, 302, 305, 265; 101/232, 237, 238, 240

[56] References Cited

U.S. PATENT DOCUMENTS

| | | | |
|---|---|---|---|
| 2,572,450 | 10/1951 | Crissy | 101/232 |
| 2,629,323 | 2/1953 | Braumgardner et al. | 101/232 |
| 4,017,004 | 4/1977 | Onoe et al. | 271/9 |
| 4,322,069 | 3/1982 | Mitchell | 271/296 |
| 4,560,293 | 12/1985 | McCumber et al. | 400/605 |
| 4,660,820 | 4/1987 | Shino et al. | 271/9 |
| 4,770,403 | 9/1988 | Katsumata et al. | 271/9 |

FOREIGN PATENT DOCUMENTS

| | | | |
|---|---|---|---|
| 3608058 | 9/1987 | Fed. Rep. of Germany | 271/302 |
| 0224770 | 12/1983 | Japan | 400/605 |
| 0040358 | 3/1985 | Japan | 271/9 |
| 0167835 | 8/1985 | Japan | 271/9 |

*Primary Examiner*—E. H. Eickholt

*Attorney, Agent, or Firm*—Takeuchi Patent Office

[57] ABSTRACT

A plurality of paper supply mechanisms are spaced in a vertical direction. A printing section is provided on the discharge side of the paper supply mechanisms for vertical movement. A driving mechanism positions the printing section to one of the paper supply mechanisms.

3 Claims, 3 Drawing Sheets

PRINTER

BACKGROUND OF THE INVENTION

The present invention relates generally to printers for copiers or the like and, more particularly, to a printer with a printing section movable in a vertical direction.

A conventional printer for copiers or the like is shown in FIG. 2. A paper supply mechanism 10A (10B) includes a paper supply tray 12*a* (12*b*) for containing paper 11*a* (11*b*), a pick-up roller 13*a* (13*b*) for picking up the top sheet 11*a*. A printing section 14 includes a printing head 15 and a platen 16 against which the printing head 15 is pressed through a sheet. A pair of paper introducing rollers 17 introduce a sheet into the printing section 14. A pair of take-out rollers 18 discharge the printed sheet from the printing section 14. A paper discharge mechanism 19A (19B) includes a pair of discharging rollers 20*a* (20*b*) for discharging the printed paper and a discharge tray 22*a* (22*b*) for receiving the discharged sheets 21*a* (21*b*). A paper guide 23 guides the paper picked up by the pick-up roller 13*a* (13*b*). A pair of transfer rollers 24 transport the paper along the paper guide 23. A discharge switch 25 selects the discharge mechanism either 19A or 19B for discharging the paper from the discharge rollers 18.

In operation, paper 11*a* and 11*b* is contained in the paper supply trays 12*a* and 12*b*, respectively. A desired sheet 11*a* or 11*b* is picked up by the pick-up rollers 13*a* or 13*b* and sent to the printing section 14. The selected sheet is transported by the introduction rollers 17 into the printing section 14 for printing by the printing head 15. The printed sheet is picked up by the take-out rollers 18 and discharged by the discharge switch 25 into the desired discharge tray 22*a* or 22*b*.

With such a printer as described above, it is necessary to increase the number of paper supply mechanisms when it is desired to increase the number of types of paper. The increased number of paper supply mechanisms would make the structure of the paper transfer system complicated, tending to cause more troubles such as paper jams. The increased number of paper supply mechanisms also requires more space for installation.

SUMMARY OF THE INVENTION

Accordingly, it is an object of the invention to provide a printer having a large number of paper types available without using a complicated paper supply structure.

Another object of the invention is to provide a printer which is easy to increase the number of paper supply mechanisms without an additional installing space when a larger number of paper types is desired.

According to the invention there is provided a printer which includes a plurality of paper supply mechanisms spaced in a vertical direction for supplying a plurality of types of paper; a printing section provided on a discharge side of the paper supply mechanisms for vertical movement; a driving mechanisms for positioning the printing section to one of the paper supply mechanisms; and a discharge section into which paper printed in the printing section is discharged.

Other objects, features, and advantages of the invention will be apparent from the following description when taken in conjunction with the accompanying drawings.

DESCRIPTION OF THE PREFERRED EMBODIMENT

Figure 1:
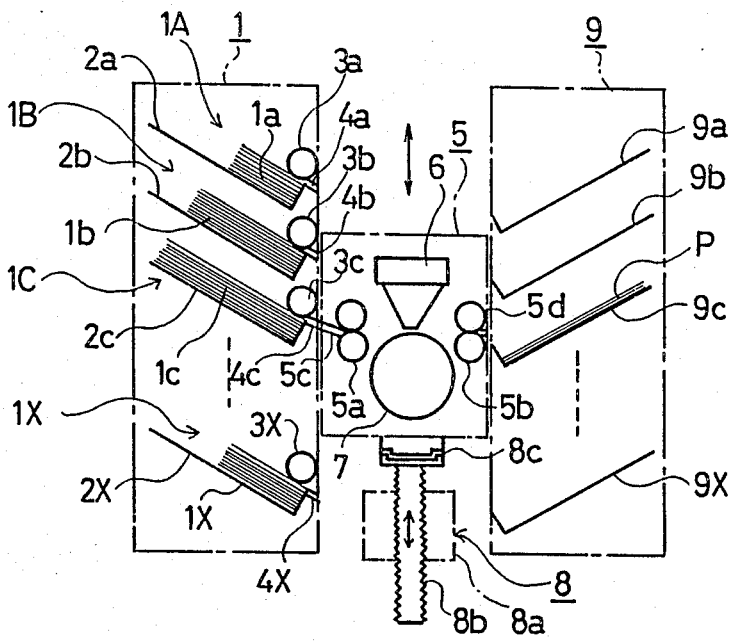
FIG. 1 is an elevational view of a printer according to an embodiment of the invention.
Figure 2:
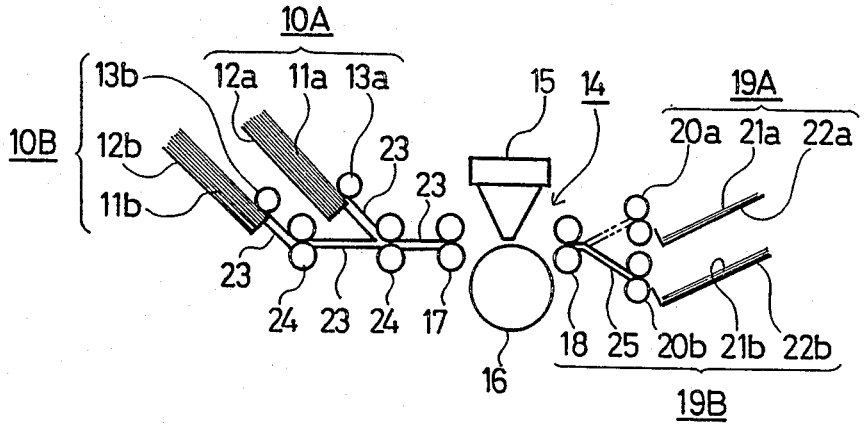
FIG. 2 PRIOR ART
FIG. 2 is an elevational view of a conventional printer.

In FIG. 1, a paper supply section 1 includes a plurality of paper supply mechanisms 1A, . . . , 1A spaced in a vertical direction and each containing paper 1*a*, . . . , 1*x*. The paper supply mechanisms 1A, . . . , 1X each include a paper supply tray 2*a*, . . . , 2*x* for containing the paper 1*a*, . . . , 1*x*, a pick-up roller 3*a*, . . . , 3*x* for sending the paper 1*a*, . . . , 1*x* to a printing section 5 to be described later, and a paper guide 4*a*, . . . , 4*x* for guiding the picked-up paper 1*a*, . . . , 1*x* to the printing section 5.

The printing section 5 is movable in a vertical direction between the paper supply section 1 and a paper discharge section 9 to be described later to be positioned at one of the guides 4*a*, . . . , 4*x* which is an outlet of the paper supply section 1. This printing section 5 includes a printing head 6, a cylindrical platen 7 against which the printing head 6 is pressed through the fed paper 1*a*, . . . , 1x, a pair of guiding rollers 5*a* for guiding the paper 1*a*, . . . , 1*x* into a space between the head 6 and the platen 7, a pair of discharge rollers 5*b* for discharging the paper P printed with the head 6 into the paper discharge section 9, a paper guide 5*c* for guiding the paper 1*a*, . . . , 1*x* from one of the paper guides 4*a*, . . . , 4*x* to the guiding rollers 5*a*, and a paper guide 5*d* for guiding the paper P from the discharge rollers 5*b* to the paper discharge section 9.

A driving mechanism 8, which moves the printing head 5 in the vertical direction, includes a motor 8*a*, a worm gear 8*b* rotatable by the motor 8*a* for vertical movement, and a coupling 8*c* for coupling the top of the worm gear 8*b* with the bottom of the printing section 5. A paper discharge section 9 includes a plurality of discharge trays 9*a*, . . . , 9*x* spaced in a vertical direction corresponding to the respective paper supply mechanisms 1A, . . . , 1X. After the paper 1*a*, . . . , 1*x* of the paper supply mechanisms 1A, . . . , 1X is printed, the printed paper P is discharged into the respective discharge trays 9*a*, . . . , 9*x*.

The printing section 5 is moved up or down by the driving mechanism 8 to one of the paper supply mechanisms 1A, . . . , 1X which contains the desired paper 1*a*, . . . , or 1*x*. The paper fed from the selected paper supply is printed in the printed section 5, and the printed paper is discharged into the corresponding discharge tray. This vertical arrangement of a plurality of paper supply mechanisms 1A, . . . , 1X eliminates a trouble of frequent replacement of the desired paper supply. The paper transport system includes only the paper guides 4*a*, . . . , 4*x* in the paper supply mechanisms 1A, . . . , 1X and the paper guides 5*c* and 5*d* in the printing section 5 so that it is easy to increase the number of paper supply mechanisms.

Figure 3:
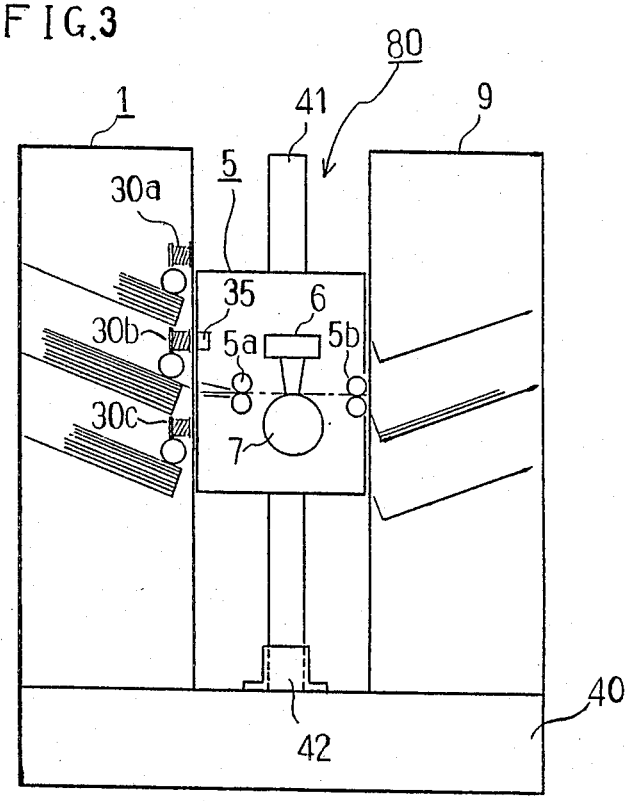
FIG. 3 is an elevational view of a printer according to another embodiment of the invention.
Figure 4:
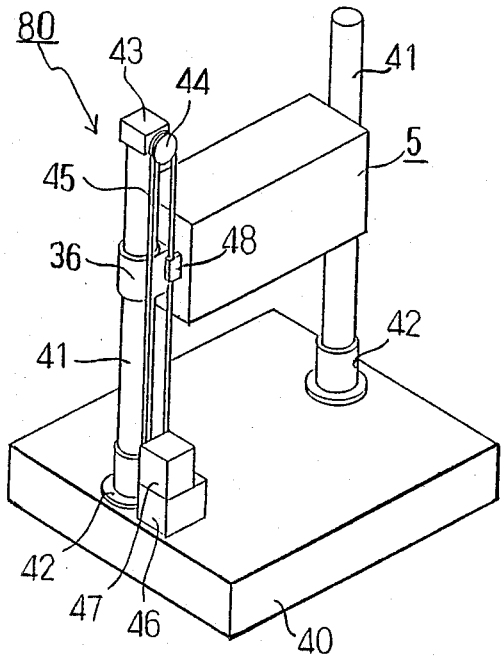
FIG. 4 is a perspective view of the driving mechanism for the printer of FIG. 3.

Another embodiment of the invention will be described with respect to FIGS. 3 and 4, wherein the same members are assigned the same reference numerals as those of FIG. 1 and their description will be omitted. Solenoids 30*a*, 30*b*, 30*c*, ... are provided in the paper supply section 1 corresponding to the respective paper supply mechanisms 1A, . . . , 1X, a magnetic sensor 35 is provided in the printing section 5 on the side of the paper supply section 1 for sensing the magnetism produced by one of the solenoids 30*a* . . . , and bearings 36 with which the printing section 5 is mounted for sliding movement along a pair of guide shafts 41 each mounted on a printer base 40 with a flange 42. A pulley holder 43 is mounted on the top of the guide shaft 41 to carry an idler pulley 44. A belt 45 is put on the idler pulley 44 and a pulley projecting from a gear box 46 which is mounted on the printer base 40. A motor 47 drives the gear within the gear box 46. A belt grip 48 connects the belt 45 with the bearings 36. The foregoing members constitute a driving mechanism 80. This driving mechanism 80 makes it possible to move the printing section 5 to the desired paper supply mechanism with high accuracy.

Alternatively, only the lowest discharge tray 9x may be used in place of the respective paper discharge trays 9*a*, . . . , 9*x* for receiving all types of paper therein. Moreover, a discharge tray may be attached to the paper guide 5*d* on the discharge side in such a manner that it moves along with the printing section 5 for receiving all types of paper therein.

As has been described above, the printer according to the invention includes a plurality of paper supply mechanisms spaced in a vertical direction, a printing section provided on the discharge side of the paper supply mechanisms for vertical movement, a driving mechanism for positioning the printing section to one of the paper supply mechanisms, and a discharge section into which the printed paper is discharged to provide a simple paper transport system, which is easy to expand the paper supply mechanisms without a need for additional space for installation.

What is claimed is:

1. A printer comprising:

a plurality of paper supply mechanisms spaced in a vertical direction for supplying a plurality of types of paper;

a printing section provided on a discharge side of said paper supply mechanisms for vertical movement;

a driving mechanisms for positioning said printing section to one of said paper supply mechanisms; and a discharge section into which paper printed in said printing section is discharge.

2. The printer of claim 1, wherein discharge section comprises a plurality of discharge trays spaced in a vertical direction corresponding to said paper supply mechanisms.

3. The printer of claim 1, wherein said driving mechanism comprises:

a plurality of solenoids each provided corresponding to each of said paper supply mechanisms; and a magnetic sensor provided in said printing section for sensing magnetism produced by one of said solenoids.

* * * * *